United States Patent [19]

Cohen

[11] Patent Number: 4,930,161

[45] Date of Patent: Jun. 5, 1990

[54] MEDICAL EXAMINATION GARMENT

[76] Inventor: Robert A. Cohen, 2460 Peachtree Rd., Apt. 1704, Atlanta, Ga. 30305

[21] Appl. No.: 335,883

[22] Filed: Apr. 10, 1989

[51] Int. Cl.[5] ..... A41B 9/00

[52] U.S. Cl. ..... 2/114; 2/408; 2/DIG. 6; 2/DIG. 7

[58] Field of Search ..... 2/409, 408, DIG. 7, 2/DIG. 8, 114, 227, 228, 238

[56] References Cited

U.S. PATENT DOCUMENTS

| | | | |
|---|---|---|---|
| 1,998,051 | 4/1935 | Gerber | 2/114 |
| 3,251,360 | 5/1966 | Melges | 128/132 |
| 3,855,635 | 12/1974 | Ramirez | 2/114 |
| 4,058,853 | 11/1977 | Boxer et al. | 2/DIG. 6 |
| 4,280,230 | 7/1981 | LaFleur | 2/408 X |
| 4,446,575 | 5/1984 | Davis | 2/400 |
| 4,608,719 | 9/1986 | Lunt | 2/114 |
| 4,807,304 | 2/1989 | McCants-Reed | 2/409 |
| 4,835,795 | 6/1989 | Lonon | 2/408 |

*Primary Examiner*—Werner H. Schroeder
*Assistant Examiner*—Jeanette E. Chapman
*Attorney, Agent, or Firm*—Thomas & Kennedy

[57] ABSTRACT

A medical examination garment [10] has a trunk [11] which has front and rear portions [18,28], and a waist region [12] where an elastic waist-band [15] is located and crotch [16]. The trunk front portion has a rectangular opening intermediate the crotch and the waist region. A front closure [21] with fasteners [23,24,25,26] is provided for covering, partially uncovering and uncovering the front opening. The trunk rear portion has a rectangular opening [29] intermediate the crotch and the waist region. Rear closure [33] is provided for selectively covering and uncovering all or a portion of a rear opening [29]. The rear closure comprises flaps [34,35] pivoted about folds [36,37] which are oriented perpendicularly to the waist-band. Fasteners [41,42,43,44] are provided for securing the flaps in an opened position uncovering the rear opening.

7 Claims, 2 Drawing Sheets

L
10
11
12
13
14
15
16
17
18
21
22
23
24
25
26
28
29
30
31
33
34
35
36
37
41
42
43
44
41,43
42,44

MEDICAL EXAMINATION GARMENT

TECHNICAL FIELD

This invention relates generally to a garment for use by medical patients, and specifically to a garment suitable for use by patients undergoing proctological, radiological or gynecological examinations and treatments.

BACKGROUND OF THE INVENTION

In proctological, radiological and gynecological examinations and treatments a doctor's and medical assistant's or radiology technologist's need for access to a patient's private body parts presents problems for both the patient and the doctor. Typically, the patient disrobes and dons an examination gown. Such a gown provides the doctor with easy access to the patient's anus for rectal examinations, but at the expense of subjecting the patient to embarrassment by needless exhibition of the patient's genitals and exposure to the coolness of the medical office or hospital environment. In these, as in most medical treatments, however, it is important that the patient be as relaxed and as comfortable as possible.

More specifically, in treatments involving proctoscopy, sigmoidoscopy, colonoscopy or barium enema, a patient is made to lay down on a table on his or her side. An endoscope or enema tip is then inserted through the anus. This enables the doctor to examine or treat the rectum, sigmoid colon or entire colon which together comprise the lower gastrointestinal tract. Access to the patient's abdomen may be required for visualization and palpation to allow the doctor to determine where the end of the endoscope is positioned and to apply external pressure to the abdomen in advancing the instrument.

Heretofore, garments have been specially devised and tailored for use by patients undergoing examinations. Exemplary of such is the garment shown in U. S. Pat. No. 4,446,575. It teaches a pair of pants that have an elongated, slit-like opening in the rear of the pants which extends between the crotch and the waist. It also has an elongated cover for the rear opening which is hinged at its lower edge adjacent the crotch. Such pants are well suited for use with standing patients but ill suited for patients lying on their sides.

Accordingly, it is seen that a need exists for a medical examination garment which provides such ready access to the anal and pelvic or abdominal regions, particularly with a patient lying on his or her side, and which may protect the patient from embarrassment and chill. It is to the provision of such a garment therefore that the present invention is primarily directed.

SUMMARY OF THE INVENTION

In a preferred form of the invention a medical examination garment, adapted to be worn by a patient undergoing examination or treatment, comprises a trunk with front and rear portions and which has a waist region and a crotch. The crotch is spaced from the waist region and extends between the front and rear portions of the trunk along an abstract center line that extends from the front portion waist region to the rear portion waist region so as to divide the trunk into two side halves. The rear portion of the trunk has a rear opening that extends between the crotch and the waist region. Rear closure means are provided for covering at least a portion of the rear opening which comprises a flap that is foldable about a fold line oriented substantially parallel to and spaced from the center line.

In another preferred form of the invention a medical examination garment, adapted to be worn by a patient undergoing examination or treatment, comprises a trunk with front and rear portions and which has a waist region and a crotch. The crotch, which is spaced from the waist, bridges the front and rear portions of the trunk. The rear portion of the trunk has a rear opening intermediate the crotch and the waist region. Rear closure means are provided for covering and uncovering at least a portion of the rear opening. The front portion of the trunk has a front opening intermediate of the crotch and the waist region with the front opening being bounded at one end by the waist region. Front closure means are provided for covering and uncovering the front opening.

Other features and advantages of the invention will become apparent upon reading the following specification when taken in conjunction with the accompanying drawings.

DETAILED DESCRIPTION

Figures 1A, 1B, 1C, 2A, 2B:
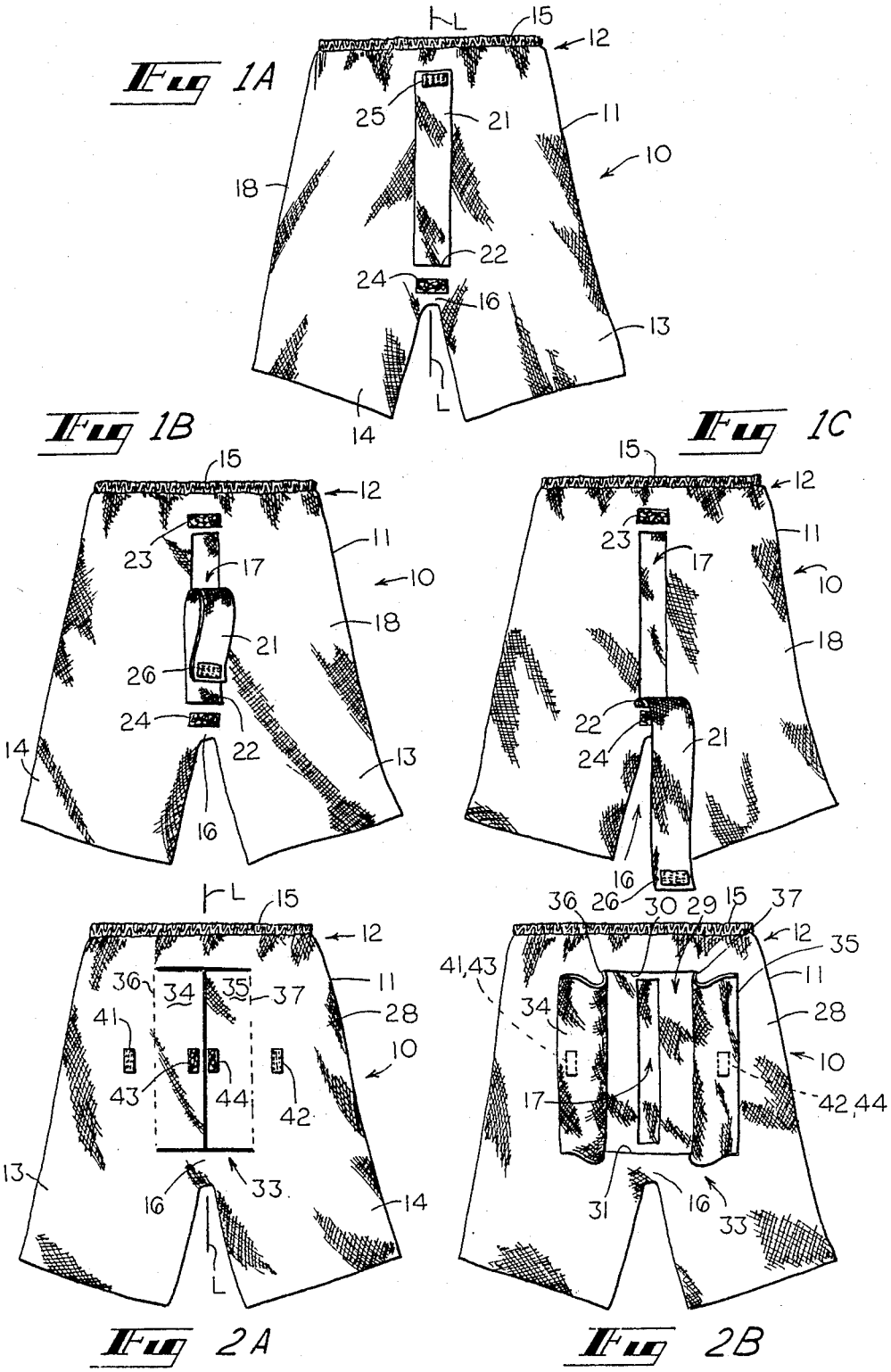
FIGS. 1A, 1B and 1C are front views of a medical examination garment that embodies principles of the invention in a preferred form, and with the figures respectively showing a front closure of the garment in closed, partly opened, and in fully opened positions.
FIGS. 2A and 2B are rear views of the medical examination garment illustrated in FIGS. 1A, 1B and 1C showing a rear closure of the garment in closed and opened positions, respectively.

With reference now in more detail to the drawings, in which like numerals indicate like parts throughout the several views, there is shown in FIG. 1A a medical examination garment having a trunk 11 with a waist region 12 where an elastic waist-band 15 is secured. The garment is of unitary construction preferably made of cloth, paper or non-woven fabric which may include an absorbent layer or ply. The garment here has bilateral symmetry of construction about an abstract center line L which divides the garment into left and right side halves. Left and right legs 13 and 14 are joined to the trunk 10 to each side of a crotch 16 which extends along the center line L between the front and rear portions of the garment. If desired these legs may be eliminated.

As best seen in FIGS. 1B and 1C, a rectangular, elongated, front opening 17 is formed in a front portion 18 of the trunk. The front opening 17 is located between the waist region 12 and the crotch 16 and straddles the center line plane L. A rectangular front closure or flap 21, which is sized to cover the opening 17, is attached at its bottom edge 22 to the front trunk portion 18 just above the crotch 16. Upper and lower Velcro strips 23 and 24 are attached to the waist region 12 between the opening 17 and the crotch 16, respectively. Other Velcro strips 25 and 26 are attached to the outside and inside of the front closure 21, respectively.

As shown in FIGS. 2A and 2B, the trunk 11 also has a rear opening 29 formed in a rear trunk portion 28. The rear opening 29 is also rectangular and lies on the center line L between the waist region 12 and the crotch 16. The rear opening has upper and lower edges 30 and 31 which are parallel to the waist-band 15 and perpendicular to the center line L.

A rear closure 33 is provided which comprises a left closure flap 34 and a right closure flap 35. The flaps are rectangular and hinged along folds or fold lines 36 and 37 which extend parallel to and spaced from the center line L. Velcro strips 41 and 42 are attached to the rear trunk portion 28. Other Velcro strips 43 and 44 are attached to flaps 34 and 35 for mating engagement with strips 41 and 42.

The garment 10 has been disclosed as having front and rear rectangular openings. By this it is meant that the openings have significant breadth and length so as to provide good access to the anal and lower abdominal regions of the patient. For use in female pelvic examinations, the front opening 17 is preferably extended to a position that corresponds to the perineum of a female patient.

OPERATION

For use, the garment is slipped on over the legs of the patient in the conventional manner of ordinary pants. Once the patient has the garment on, it is held up by elastic waist-band 15. To remove the garment, the garment is slipped off over the patient's legs.

To uncover a portion of the front opening 17, the Velcro strips 26 and 23 are disengaged from one another and the front closure 21 folded downwardly, as shown in FIG. 1B. To secure the front closure in this partly opened position, strip 25 on the front closure is engaged with strip 24 on the trunk front portion 18. To move the front closure from this partly opened position to the fully opened position shown in FIG. 1C, strips 24 and 25 are disengaged from one another and the front closure is folded further downwardly to the position shown in FIG. 1C. To recover the front opening front closure 21 is positioned over the opening and strip 26 is engaged with strip 23.

To move the rear closure 33 from the closed position of FIG. 2A to the fully opened position of FIG. 2B, flaps 34 and 35 are folded about fold lines 36 and 37 laterally away from each other. To secure the rear closure 33 in this fully opened position, Velcro strip 43 on flap 34 is engaged with Velcro strip 41 on the trunk rear portion 28 and strip 44 on flap 35 is engaged with strip 42 on trunk rear portion 28. Alternatively, the rear closure may be moved and secured in a partly opened position by moving and securing just one of the flaps 34, 35 in the above manner.

Figure 3:
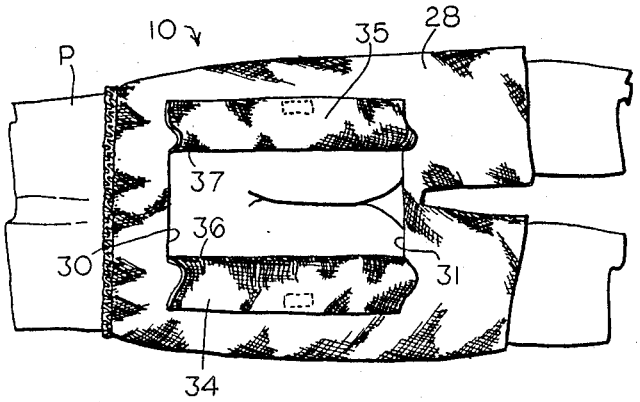
FIG. 3 is a rear view of the garment shown with a patient wearing it while lying sideways in a horizontal position, and with the rear closure shown in an opened position.

As pointed out earlier, in many proctological procedures the patient is made to lay on his side. FIG. 3 illustrates a patient P wearing the medical examination garment 10, while positioned in this manner. Note that in this posture the rectangular opening 29 provides good access to the patient's anal region while covering the patient's genitals. With the patient in this horizontal position, flaps 34 and 35 are folded about fold lines 36 and 37 which are now horizontal. The upper flap 35 here is held open by the mating Velcro strips while the lower flap may either be simply draped or also fastened. A two-flap closure constructed and used in this manner has been found to provide unfettered access to the anal region and to be capable of being better secured in an opened position as opposed to a single flap pivoted about an axis parallel to the waist. Of course a single flap may be provided instead of two for folding in this direction and manner. However, two are preferred so as to work equally well regardless of which side that the patient lies upon.

Figure 5:
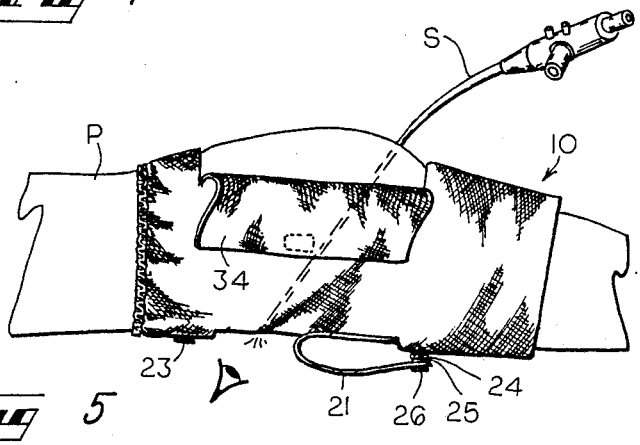
FIG. 5 is a side view of the garment shown with a patient wearing it while lying sideways in a horizontal position, and with both the front and rear closures shown in opened positions with a medical instrument inserted into the body of the patient.

With the patient P lying on his side while wearing the medical examination garment, a doctor may open the rear closure flaps 34 and 35 and secure them in the opened position as shown in FIG. 3. An endoscope S as shown in FIG. 5, or other instrument, i.e. enema tip, may then be inserted through the anus of the patient. Since procedures of this sort make many patients nervous and uncomfortable, the medical examination garment helps to minimize this by protecting the patient from needless embarrassment and chills since the crotch remains covering the genitals.

Figure 4:
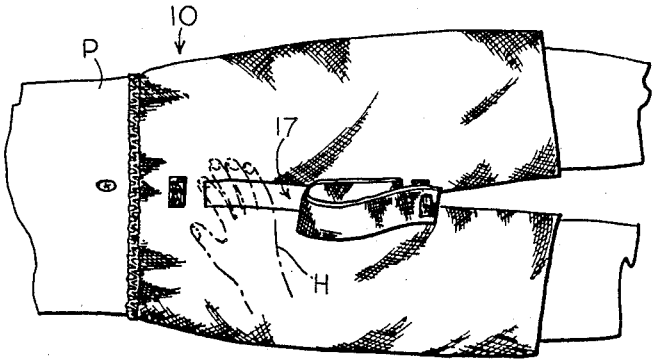
FIG. 4 is a front view of the garment shown with a patient wearing it while lying sideways in a horizontal position, and with a front closure shown in a partly opened position.

As shown in FIG. 4, front opening 17 may be uncovered for access to the lower abdominal region of the patient P. The partially uncovered opening 17 of FIG. 4 is large enough to allow a hand H of a doctor or medical assistant to be inserted therethrough. This abdominal access is useful for visualization and palpation to allow the doctor to determine where the endoscope is located and to allow external pressure to be applied to the abdomen to help advance the instrument. In some situations the doctor may be able to determine the position of the end of the scope S by observing the patient's lower abdomen through opening 17, looking for the light emanating from the scope S, as seen in FIG. 5. The light is usually of sufficient strength to be observed through the skin and tissue of the patient.

It thus is seen that a novel medical examination garment is now provided which may protect a patient from chills and undue embarrassment while yet providing a doctor with ready access to both the patient's anal and lower abdominal regions. It should be understood, however, that the garment has been disclosed here in a preferred form. Many modifications, additions and deletions may be made thereto without departing from the spirit and scope of the invention as set forth in the following claims.

I claim:

1. A garment adapted to be worn by a patient undergoing medical examination or treatment such as a proctological, radiological or colonoscopic examination or the like in which the patient is made to lay on his or her side, and with the garment comprising:

a trunk with front and rear portions that have a waist region;

a crotch extending between said front and rear portions and spaced from said waist region along a centerline that divides said trunk into two side halves;

said trunk rear portion having an opening therein extending between said crotch and said waist region; and movable rear closure means for substantially covering said rear opening, said rear closure means comprising a first flap having a size and a shape for covering and uncovering a first portion of said rear opening and a second flap having a size and a shape for covering and uncovering a second portion of said rear opening, said first and second flaps each being foldable about a fold oriented generally parallel to and spaced from said center line for movement to a position uncovering said rear opening, whereby the patient may undergo examination or treatment with the patient lying on his or her side and the closure means positioned uncovering the rear opening and with the crotch covering the patient's genitals.

2. The garment as claimed in claim 1 and further comprising two leg portions extending from said trunk adjacent said crotch.

3. The garment as claimed in claim 1 wherein said trunk front portion has an opening therein extending between said waist region and said crotch.

4. A garment adapted to be worn by a patient undergoing medical examination or treatment such as a proctological, radiological, or colonoscopic examination or the like in which the patient is made to lay on his or her side, and with the garment comprising:

a trunk with front and rear portions that have a waist region;

a crotch extending between said front and rear portions and spaced from said waist region along a centerline that divides said trunk into two side halves;

said trunk rear portion having an opening therein extending between said crotch and said waist region;

movable rear closure means for covering at least a portion of said rear opening, said rear closure means comprising a first flap for covering a first portion of said rear opening and a second flap for covering a second portion of said rear opening, said rear closure means being foldable about a fold oriented substantially parallel to and spaced from said center line for movement to a position uncovering said rear opening; and rear closure means that comprises first rear closure securing means for securing said first flap in a position uncovering said first portion of said rear opening and second rear closure securing means for securing said second flap in a position uncovering said second portion of said rear opening;

whereby the patient may undergo examination or treatment with the patient lying on his or her side and the closure means positioned uncovering the rear opening and with the crotch covering the patient's genitals.

5. A garment adapted to be worn by a patient undergoing medical examination or treatment comprising:

a trunk with front and rear portions that have a waist region;

a crotch bridging said trunk front and rear portions spaced from said waist region;

said trunk rear portion having an opening therein intermediate said crotch and said waist region;

movable rear closure means for covering and uncovering said rear opening;

said trunk front portion having an opening therein intermediate said crotch and said waist region that is bounded at one end by said waist region;

movable front closure means for covering and uncovering said front opening; and rear securing means for securing said rear closure means in said uncovering position and front securing means for securing said front closure means in said uncovering position, whereby a patient while wearing the garment may undergo examination or treatment with the garment providing ready access to the anal and lower abdominal regions of the patient while covering the patient's genitals.

6. The garment as claimed in claim 5 wherein said rear securing means further includes means for securing said rear closure means in said covering position and wherein said front securing means further includes means for securing said front closure means in said covering position.

7. The garment as claimed in claim 5 further comprising two leg portions extending from said trunk aside said crotch.

* * * * *